United States Patent [19]

Wilson

[11] Patent Number: 4,656,680

[45] Date of Patent: Apr. 14, 1987

[54] METHOD AND APPARATUS FOR OSCILLATING A BABY TO SLEEP

[76] Inventor: Roger F. Wilson, Rte. 1 74-224, O-Bar Rd., Sarasota, Fla. 33583

[21] Appl. No.: 733,092

[22] Filed: May 13, 1985

[51] Int. Cl.[4] ..... A47D 9/02

[52] U.S. Cl. ..... 5/108; 5/107; 5/109

[58] Field of Search ..... 5/101, 105, 107, 108, 5/109; 128/33

[56] References Cited

U.S. PATENT DOCUMENTS

| | | | |
|---|---|---|---|
| 2,805,427 | 9/1957 | Edgmon | 5/109 |
| 2,896,225 | 7/1959 | Tonkin | 5/105 |
| 2,979,735 | 5/1960 | Helmer | 5/105 |
| 3,123,019 | 3/1964 | Blair | 5/109 |
| 3,648,307 | 3/1972 | Mende | 5/108 |
| 3,653,080 | 4/1972 | Hafele | 5/108 |
| 3,806,966 | 4/1974 | Thompson | 5/109 |
| 3,874,011 | 4/1975 | Walsh et al. | 5/108 |

*Primary Examiner*—Gary L. Smith
*Assistant Examiner*—Michael F. Trettel
*Attorney, Agent, or Firm*—William E. Mouzavires

[57] ABSTRACT

A baby is oscillated to sleep by placing it in a carrier and pivoting the carrier in oscillation about a horizontal axis adjacent the foot end of the carrier by means of a rotating cam which provides a special predetermined motion that is effective to induce the baby to sleep. The carrier is removably mounted on a carrier support which is pivoted to an underlying base for oscillation about the aforementioned axis to impart similar motion to the carrier. The can and its drive means is mounted on the base and enclosed together with the base by the carrier support. In the preferred embodiment, wheels are mounted to the base to allow the apparatus to be moved back and forth over a ground surface.

21 Claims, 9 Drawing Figures

ALL GRAPHS DEPICT ½ (180°) OF CAM AND MOTION,
OPPOSITE SIDES SYMETRICAL

SPECIFIC DIMENSIONS FOR SPECIAL CAM- (HALF SHOWN)

METHOD AND APPARATUS FOR OSCILLATING A BABY TO SLEEP

BACKGROUND OF INVENTION

Motorized cribs, cradles or baby carriers are known in the art as exemplified in U.S. Pat. Nos. 2,529,721, 3,653,080 and 4,141,095. In such devices, a motor is employed to drive a crank or a reciprocating mechanism which is connected to the baby carrier to oscillate it about a horizontal pivot axis. The motion imparted to the carrier is such as achieved, for example, by a crank rotating about a circular path. Such motion yields equal acceleration levels at the opposite ends of the stroke. In devices such as shown in U.S. Pat. Nos. 3,653,080 and 4,141,095, the baby is held in a partially upright position and is rocked to and fro. With such devices, care must be taken to insure the baby is not accidentally thrown forwardly from the carrier.

OBJECTS OF PRESENT INVENTION

An object of the present invention is to provide novel and improved method and apparatus for oscillating a baby to sleep.

Another object of the present invention is to provide such a method and apparatus that imparts a novel predetermined motion to the baby which motion is effective to induce sleep in a safe and gentle manner. Included herein is such method and apparatus which oscillates the baby in a generally horizontal position through a short stroke over a variable range of speed during which the baby is subjected to the unique motion described.

A still further object of the present invention is to provide novel apparatus for oscillating a baby to sleep and which apparatus is safe and effective while also possessing an attractive appearance that will not detract from the decor of the baby's room. Included herein is such apparatus that is portable.

A still further object of the present invention is to provide such apparatus that will achieve the above objects and yet may be designed for commercial production and with a durable construction that will successfully operate over along periods of repeated use.

SUMMARY OF INVENTION

In summary, the method and apparatus of the present invention utilizes a baby carrier for receiving the baby in a generally horizontal reclining position. The baby carrier is oscillated up and down by a drive means between opposite upper and lower extremes of travel such that a baby in the carrier will experience greater acceleration levels as the carrier reaches the lower extremes of travel than experienced as the carrier reaches the upper extreme of travel. This unique arrangement and difference in acceleration levels has been found effective in inducing sleep in babies. The acceleration, of course, is what the baby feels. It follows that the acceleration at the bottom of the stroke will cause the baby to feel pressed into the carrier while the acceleration at the top of the stroke will cause the baby to feel light (decreased pressure) in the carrier. This difference of acceleration levels in the preferred embodiment is about 1.5 times. This distance between the upper and lower extreme of travel is maintained in the present embodiment on the order of ⅛ to 5/16 of an inch, measured at the baby's head end of the apparatus. The acceleration level differences between the top of the stroke and the bottom, as well as the stroke length are both determined in part by the rpm range chosen, which is about 60 to 240 rpm in the preferred embodiment.

In the preferred embodiment of the invention, the drive means includes a special rotatable cam engageable by suitable method with the underside of a support on which the carrier is mounted to oscillate with the support. The cam is driven by a motor through a suitable gear reduction and these elements are mounted on a base where they are enclosed and concealed from view by the support. Additionally, in the preferred embodiment, the baby carrier is detachably mounted to the baby carrier support and the latter is pivotally mounted to the base to be oscillated by the cam as described above. Other features of the invention will be described below.

DRAWINGS

Other objects and advantages of the present invention will become apparent from the following more detailed description taken in conjunction with the attached drawings in which.

DETAILED DESCRIPTION

Figure 1:
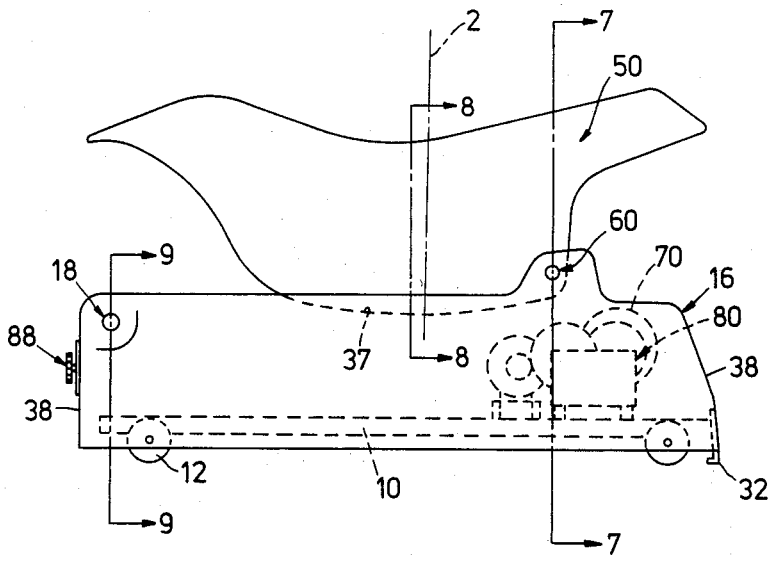
FIG. 1 is a side elevational view of apparatus embodying the present invention.

Referring now to the drawings in detail, there is shown for illustrative purposes only, apparatus embodying the present invention. Referring to FIGS. 1, 2, 3 and 9, the apparatus includes a base 10 shown as being a flat, generally rectangular body having front and rear wheels 12 mounted on suitable axles 14 allowing the apparatus to be easily moved over a surface.

Figure 9:
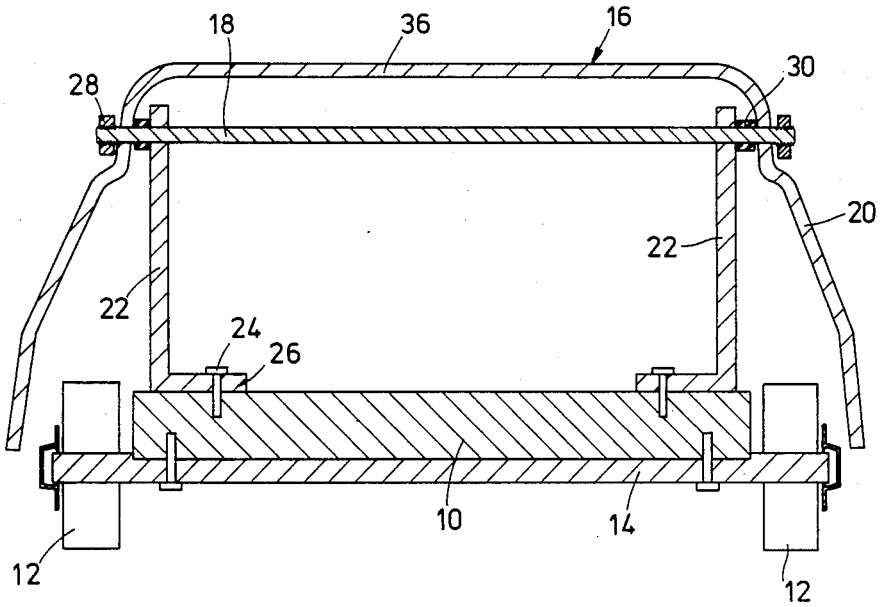
FIG. 9 is an enlarged, cross-sectional view taken generally along lines 9—9 of FIG. 1.

Mounted on the base 10 for oscillating movement is a baby-carrier support generally designated 16. In the specific embodiment shown, this mounting is achieved through a pivot pin 18 extending transversely along a horizontal axis through opposite side walls 20 of the baby-carrier support 16 while being received through apertures 19 in upstanding brackets 22 fixed to the base by suitable fasteners 24 extending through right-angle leg portions 26 of the brackets as shown in FIG. 9. As shown in FIG. 9, pivot pin 18 is maintained in position by lock nuts 28 received on the ends of the pin on the outside of the support walls 20. Spacers 30 are provided about the pivot pin between the walls 20 and brackets 22. Additionally, in the preferred embodiment, carrier support 16 is held on base 10 against removal by a stop shown in the form of lug 32 fixed to the inside lower surface of an end wall 38 of carrier support 16 to be engageable with the underside of the base 10. Stop 32 is spaced sufficiently below base 10 to allow the carrier support 16 to pivot about pin 18 between upper and lower extremes of travel as will be described further below.

Figure 7:
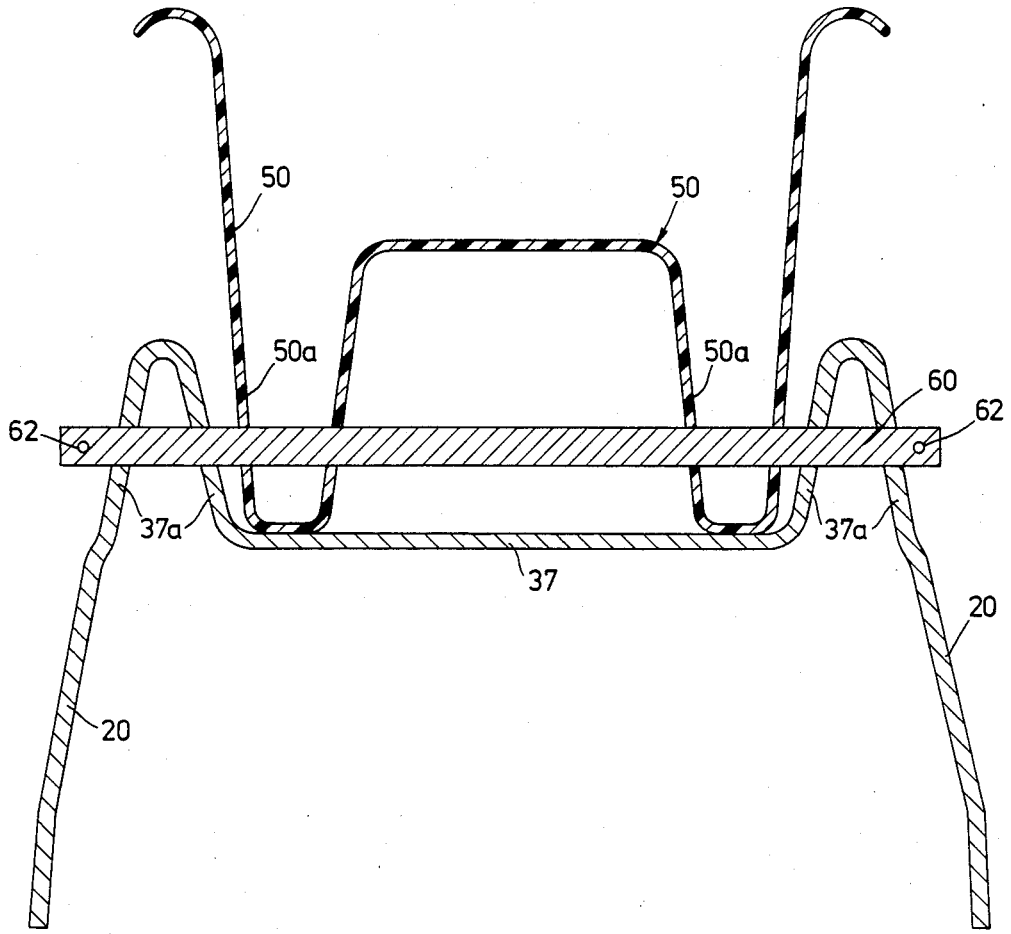
FIG. 7 is an enlarged, cross-sectional view taken generally along lines 7—7 of FIG. 1 and with portions removed.
Figure 8:
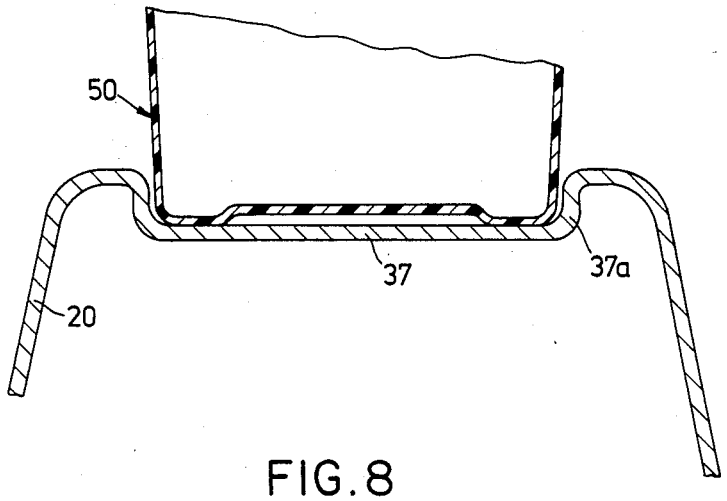
FIG. 8 is an enlarged, cross-sectional view taken generally along lines 8—8.

As will be seen from FIGS. 1 and 9, carrier support 16 has an generally inverted rectangular pan-like shape including a generally horizontal top wall 36 opposite side walls 20 and end walls 38 defining an enclosure which covers base 10 and a drive mechanism mounted on the base as will be described below. In the preferred embodiment, the top wall 36 of the carrier support 16 is recessed intermediate its ends at 37 as shown in FIGS. 1, 7 and 8 for receiving a baby carrier generally designated 50 to be described below. The carrier support 16 may be made from any suitable material such as, for example, a molded rigid plastic of sufficient strength to support the baby carrier 50 and a baby placed in the carrier 50.

The baby carrier 50 is, of course, cradle-shaped and dimensioned to receive a baby in reclining position. The carrier 50 may be easily made from a rigid molded plastic or any suitable construction. The present baby carrier has a length of about twenty-four inches with a head end, shown as the right-hand side side of the carrier in FIG. 1, for receiving the head of the baby with the opposite end, of course, receiving the feet of the baby. As best shown in FIGS. 7 and 8, the lower side walls 50*a* of the baby carrier are received in the recess of the carrier support formed by the top wall 37 and opposite internal walls 37*a*. The recess including walls 37*a* basically diminishes in depth from the head end of the carrier towards the opposite end. The shape of the top wall 37 of the recess is made to conform to the shape of the lower surface of the portion of the carrier 50 received in the recess.

The baby carrier 50 is connected to the support 16 to properly position the baby carrier relative to the support and to allow the carrier 50 to oscillatingly pivot together with the support between upper and lower extremes of travel. In the preferred embodiment, the carrier 50 is positioned so that the pivot 18 will be spaced about 8 or 10 inches from the center of gravity 2 of the combined carrier 50 and baby. The precise position of the pivot 18 from the center of gravity 2, as long as it allows for the same basic oscillation motion as found in the preferred embodiment, should not be critical. Additionally, it is preferred that the carrier 50 be releasably connected to the support 16 to allow the carrier to be removed from the support 16, for example, to transport the baby in the carrier without the support 16 and base 10 or to clean the carrier 50. Referring to FIG. 7, in the preferred embodiment, this connection is effected through a lock pin 60 received through aligned apertures in wall portions 37*a* of the support 16 and apertures in lower wall portions 50*a* of carrier 50. Lock pin 60 is, of course, removable from the aforementioned apertures to release the baby carrier 50 from the support. To connect the carrier to the support, the lock pin is, of coruse, inserted through the aforementioned apertures, and stop pins (not shown) are inserted in apertures 62 in the opposite ends of the lock pin. Although not shown, the baby carrier 50 may be permanently fixed to the support 16 such as through an integral molded construction or otherwise, however, it is preferred that the carrier 50 be releasably connected to the support as stated.

Figure 2:
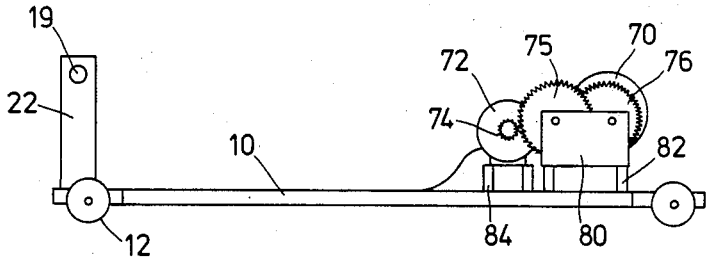
FIG. 2 is a side elevational view of a base included in the apparatus and shown with other portions of the apparatus removed.
Figure 3:
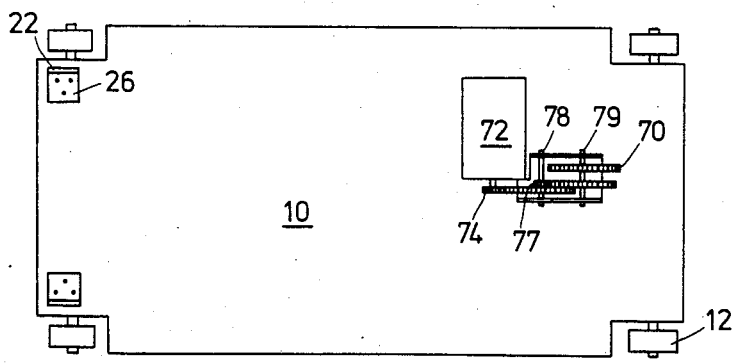
FIG. 3 is a plan view of the base shown in FIG. 2.

Referring now to FIGS. 2 and 3, the carrier support 16 is pivotally oscillated about pivot 18 through means of a cam 70 driven by a motor 72 acting through a drive gear 74 and speed reduction gears 75, 77 and 76, all of which are mounted on base 10. Drive gear 74 is driven by the output shaft of motor 72, and drives drive gear 75 mounted on a shaft 78 to drive the same. Pinion gear 77 is fixed to shaft 78 and drives drive gear 76 which is fixed to a shaft 79 to drive the same. Cam 70 is fixed to shaft 79 to be rotated thereby. Shafts 78 and 79 are mounted in opposed walls of a bracket 80 which is preferably mounted to the base by rubber blocks 82. Motor 72 is similarly mounted to base 10 through rubber blocks 84. In one preferred embodiment a 1/15 horsepower 5000 RPM motor 72 is employed with a speed reduction at gears 74, 75, 76 and 77 of about 21 to 1 yielding about 240 RPM at the cam 70. Additionally, it is preferred that a means for providing variable speed be employed, and FIG. 1 shows a speed control knob 88 exterior of the carrier support 16 at the foot end to control the speed of the cam. In the present embodiment the speed is controlled electrically. It will be appreciated that manual or automatic speed control may be achieved through various mechanical and/or electrical means. As well, although one type of drive system has been shown and described, it will be appreciated that other types may be substituted, for example, friction, chain or belt drives, with production considerations, reliability, and low noise levels the controlling factors. It will also be appreciated the cam may be either the rotating type or the type which moves back and forth. It will be seen that when the apparatus is fully assembled, the drive system on the base 10 will be completely concealed by the carrier support shell 16.

As described above, cam 70 engages the undersurface of the top wall 37 of the carrier support 16 to raise and lower the carrier support and, in turn, the carrier 50 between upper and lower limits of travel. To this end, the undersurface of wall 37 engaged by the cam 70 has a flat shape. Although only one method of engaging the cam 70 with carrier support 16 has been shown and described, it will be appreciated that other methods may be substituted. For example, providing a material of suitable low friction mounted to the undersurface of the carrier support 16 for the cam 70 to engage. Another possibility is to mount an idler wheel on the undersurface of the carrier support for the cam 70 to engage, this method greatly reducing friction and heat. In the preferred embodiment, the cam is dimensioned to provide a short stroke on the order of ⅛ to 5/16 of an inch and preferably about three sixteenths of an inch (3/16") when the upper cam speed is about 240 RPM. That is to say, that the distance between the upper end and lower limits of travel of the baby carrier 50 or the support 16 in the preferred embodiment is about 3/16", measured about in line with the baby's head. Although the aforementioned short stroke has been found to produce effective results, a stroke on the order of ⅛" to 3" may also be employed.

Figure 4:
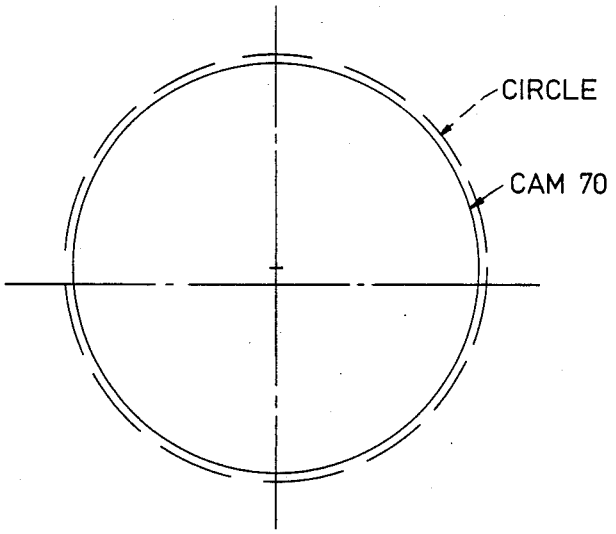
FIG. 4 is an enlarged side view of a cam included in the apparatus and with dotted lines showing an imaginary circle.
Figure 6:
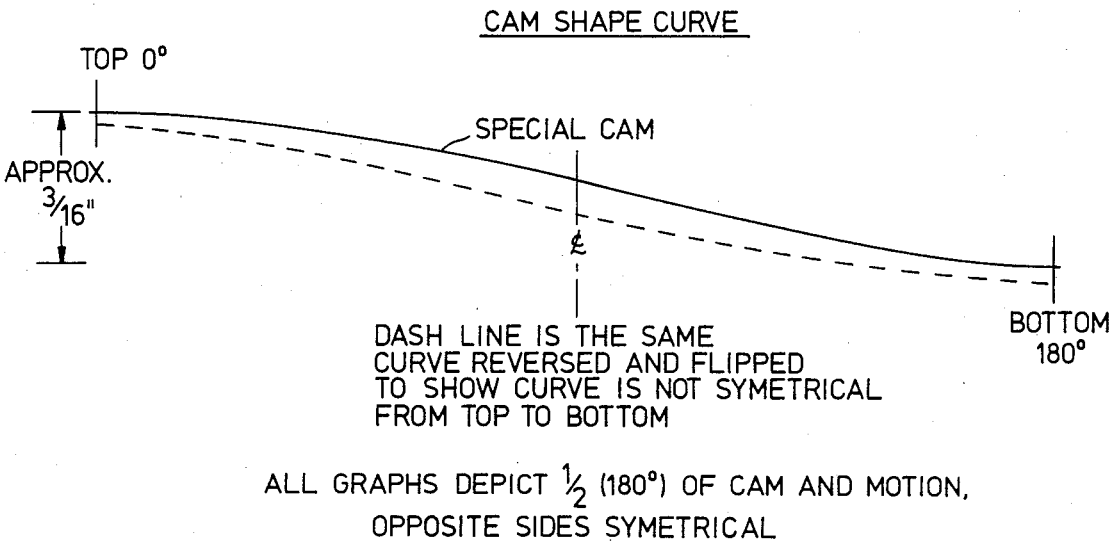
FIG. 6 is a graph of the shape of the cam.
Figure 5:
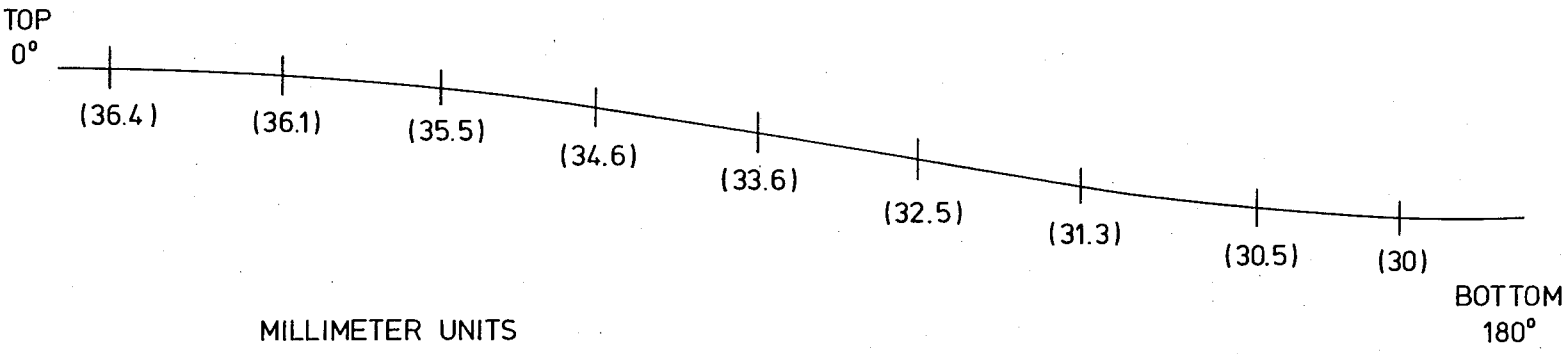
FIG. 5 is a graph of various dimensions of the cam.

Moreover, in accordance with one of the features of the invention, the cam 70 is provided with a predetermined peripheral shape (profile or cam curve) which engages, through various possible methods described above, the underside of the support wall 37 and governs the acceleration levels and motion imparted to the baby carrier 50 and the baby held therein during use. The actual shape of the cam 70 is shown by the full line in FIG. 4. To contrast the shape or curve of the cam 70, a circle has been drawn in dotted lines about the cam 70 in FIG. 4. FIG. 6 also shows the curve of a 180 degree portion of the cam in the form of a graph while FIG. 5 is a similar graph with dimensions of present cam curve measured to the center of rotation of the cam.

In actual operation of the apparatus, and starting for the sake of description with the upper limit of travel (the high point, or the top of the stroke) of the carrier 50, as the cam 70 continues to rotate and the carrier begins its descent, the speed of the carrier will increase at a decreasing rate until the cam 70 has rotated about 105 degrees at which point the speed will be maximum and the acceleration level will be zero. As the cam 70 continues to rotate in, of course, the same direction, the speed of the carrier 50 will begin to slow down at an increasing rate (slow at an increasing level of acceleration) until it reaches the lower limit of travel at which point the baby in the carrier 50 will experience acceleration levels of about 1.5 times greater than the acceleration levels experienced when the carrier reached the upper limit of travel. When the carrier 50 reaches the lower limit of travel its speed will be zero, but as the cam 70 continues to rotate (in the same direction), the carrier 50 will begin to rise towards its upper limit of travel with a speed that increases at a decreasing rate. When the cam 70 has rotated about 75 degrees from the lower limit of travel, the carrier 50 speed will again be maximum and as the cam 70 continues to rotate, the carrier 50 will begin to slow down at an increasing rate until it reaches the upper limit of travel at which point the carrier 50 is again at zero speed for an instant and then starts to descend to repeat the cycle described above. As the carrier reaches its upper limit of travel, the baby will experience significantly lower acceleration levels than experienced when the carrier 50 reaches its lower limit of travel. Such motion imparted to the baby by virtue of the cam 70 shape (curve) has been found to be most effective in inducing sleep in the baby, the effectiveness of said motion allowing for a short, safe stroke of travel. Although fairly specific apparatus and motion figures have been shown and described, it will be appreciated that the figures given for acceleration level differences, stroke length, and RPM, as well as the means for imparting said motion figures to the baby could be varied somewhat without departing from the basic principles of the preferred embodiment.

In order to disassemble the apparatus and gain access to the base for service or cleaning, the pivot pin 18 is removed from the support shell 16 which is then slid forwardly to clear stop 32 from the base 10 allowing the support shell 16 to be raised off the base. The carrier 50 is removed from the support shell 16 by withdrawing the lock pin 60 from the carrier 50 and support shell 16, as described earlier, to thus free the carrier.

What is claimed is:

1. Apparatus for oscillating a baby to sleep comprising in combination; a base, a baby carrier support pivotally mounted on the base for oscillating movement about a generally horizontal pivot axis such that the support is raised and lowered relative to the base between upper and lower extremes of travel, a baby carrier having a head end and an opposite foot end and adapted to hold a baby in reclining position with the head of the baby located at the head end of the carrier, said baby carrier being removably mounted to said baby carrier support to move with the support relative to the base, and drive means for oscillating the baby carrier support, said drive means including a cam mounted on the base below said support, said cam being shaped to impart to the carrier greater acceleration levels in the vicinity of the lower extreme of travel than in the vicinity of the upper extreme of travel, and wherein there is further included releasable connecting means connecting said carrier to said support while being releasable to permit said carrier to be removed from said support.

2. The apparatus defined in claim 1 wherein said cam is rotatable and has a peripheral surface engageable with said support to oscillate the support and, in turn, the carrier.

3. The apparatus defined in claim 1 wherein said cam is shaped such that a baby in the carrier will experience acceleration levels as the baby, carrier, and support reaches the lower extreme of travel of at least 1.5 times greater than the acceleration levels experienced as the baby, carrier, and support reaches the upper extreme of travel.

4. The apparatus defined in claim 3 wherein the distance between the upper and lower extremes of travel is on the order of about 5/16 to ⅛ of an inch, measured at the head end.

5. Apparatus defined in claim 1 wherein said support has an upper surface receiving the carrier and a side wall depending from the upper surface, said upper surface and side wall of said support substantially enclosing the base and the drive means.

6. Apparatus defined in claim 5 wherein said upper surface of said support has a depressed portion receiving a lower portion of said carrier.

7. The apparatus defined in claim 1 wherein said cam is engageable with said support to raise and lower said support in oscillation about said axis.

8. The apparatus defined in claim 1 wherein said drive means includes a motor, and a speed reduction means operatively interconnecting said motor and cam to drive the cam, said cam, motor and speed reduction means being mounted on said base.

9. The apparatus defined in claim 8 wherein said support substantially encloses the base including said motor, speed reduction means, and cam.

10. The apparatus defined in claim 8 further including means for varying the speed of said motor including a control knob mounted externally thereof.

11. The apparatus defined in claim 1 wherein said support has a top wall extending in a generally horizontal plane, said carrier is mounted on said top wall of the support, said support including a side wall depending from said top wall, said drive means is mounted on said base, and said top and side wall of said support encloses the base including said drive means.

12. The apparatus defined in claim 11 wherein said cam is engageable with an upper portion of said top wall of said support.

13. The apparatus defined in claim 1 wherein the distance between upper and lower extremes of travel of the carrier is on the order of about 3 inches to ⅛ of an inch, measured at the head end.

14. An apparatus for oscillating a baby to sleep, the apparatus including a baby carrier adapted to receive a baby in reclining position and drive means for oscillating the baby carrier between upper and lower extremes of travel, the improvement wherein the drive means excluding the effect of gravity oscillates the baby carrier such that the carrier will reach acceleration levels when the carrier is in the vicinity of the lower extreme of travel greater than the acceleration levels reached when the carrier is in the vicinity of the upper extreme of travel.

15. The apparatus defined in claim 14 wherein said drive means oscillates the baby carrier such that a baby in the carrier will experience acceleration levels as the carrier reaches the lower extreme of travel of at least 1.5 times greater than the acceleration levels experienced as the carrier reaches the upper extreme of travel.

16. The apparatus defined in claim 15 wherein the drive means oscillates the carrier such that the distance between the upper and lower extremes of travel of the carrier is on the order of $\frac{1}{8}$ to 5/16 of an inch.

17. The apparatus defined in claim 14 wherein the drive means oscillates the baby carrier such that as the carrier approaches the lower extreme of travel, the carrier will slow down at an increasing rate which is greater than the rate at which the carrier slows down as the carrier approaches the upper extreme of travel.

18. Apparatus for oscillating a baby to sleep, the apparatus including a baby carrier adapted to receive a baby in reclining position and drive means for vertically oscillating the baby carrier, the improvement wherein the drive means includes means movable between upper and lower extremes of travel and being constructed to reach acceleration levels in the vicinity of the lower extreme of travel greater than that reached in the vicinity of the upper extreme of travel for the purpose of inducing sleep in a baby held in the carrier.

19. Apparatus defined in claim 18 wherein said last-defined means includes a cam having a predetermined shape to produce said acceleration levels.

20. Apparatus defined in claim 19 wherein the acceleration produced by the cam in the vicinity of the lower extreme of travel is at least 1.5 times greater than that produced in the vicinity of the upper extreme of travel.

21. Apparatus defined in claim 18 wherein the acceleration produced by the drive means in the vicinity of the lower extreme of travel is at least 1.5 times greater than that produced in the vicinity of the upper extreme of travel.

* * * * *